US006582644B2

(12) United States Patent
Kim et al.

(10) Patent No.: US 6,582,644 B2
(45) Date of Patent: Jun. 24, 2003

(54) METHOD FOR PRODUCING HOLLOW RAYON FIBERS

(75) Inventors: Ik Soo Kim, Suwon-si (KR); Jong Soo Ahn, Seoul (KR); Byoung Hak Kim, Suwon-si (KR)

(73) Assignee: SK Chemicals Co., Ltd., Suwon-Si (KR)

( * ) Notice: Subject to any disclaimer, the term of this patent is extended or adjusted under 35 U.S.C. 154(b) by 0 days.

(21) Appl. No.: 10/035,294

(22) Filed: Jan. 4, 2002

(65) Prior Publication Data

US 2002/0136892 A1 Sep. 26, 2002

(30) Foreign Application Priority Data

Jan. 18, 2001 (KR) ..... 10-2001-2869

(51) Int. Cl.[7] ..... D01F 2/08; D01F 2/00
(52) U.S. Cl. ..... 264/188; 428/393; 428/398
(58) Field of Search ..... 428/362, 369, 428/364, 393, 376, 398; 264/188, 197, 209; 536/30

(56) References Cited

U.S. PATENT DOCUMENTS 4,086,418 A * 4/1978 Turbak et al. ..... 536/30
4,130,689 A * 12/1978 Costa ..... 428/398
4,242,411 A * 12/1980 Costa ..... 428/369

FOREIGN PATENT DOCUMENTS

EP WO02/057521 A1 * 7/2002

* cited by examiner

*Primary Examiner*—N. Edwards
(74) *Attorney, Agent, or Firm*—Browdy and Neimark

(57) ABSTRACT

Disclosed is a simple and safe method for producing hollow rayon fibers, which are light and heat-insulating. The fibers, having a cross section of FIG. 1, are produced by forming a cellulose layer with a mixed crystalline structure of cellulose II and IV through selective saponification of a portion of cellulose acetate fibers with the use of alkali, followed by dissolving a portion which remains unsaponified, with the use of an organic solvent.

5 Claims, 1 Drawing Sheet

METHOD FOR PRODUCING HOLLOW RAYON FIBERS

TECHNICAL FIELD

The present invention relates to a novel method for producing hollow rayon fibers, which are light and heat-insulating, in a simple and environmentally friendly manner.

PRIOR ART

Rayon fibers, which are artificial fibers with the same chemical structure as cellulose, are defined as regenerated cellulose fibers, in which 15% or fewer hydroxyl groups are substituted (Fibers Chemistry, Manachem Lewin Eli M. Pearce, Dekker p.914, 1985), and usually used in high-grade applications with favorable intrinsic brightness, specific gravity, and sense of touch.

Viscose rayon (hereafter, referred to simply as 'rayon') can be produced by spinning a sodium cellulose xanthate solution, prepared by adding a sodium hydroxide solution and $CS_2$ to cellulose, into an aqueous solution of sulfuric acid and zinc sulfate. Such method was commercialized, but recent legislation, in response to environmental concerns stemming from air pollution, has been enacted to make the method useless because it produces harmful substances such as $CS_2$.

DISCLOSURE OF THE INVENTION

Therefore, it is an object of the present invention to provide a commercial method for producing hollow rayon fibers, which are light and heat-insulating, in a simple and safe manner.

To accomplish the above object, the present invention provides a method for producing hollow rayon fibers, which comprises the steps of saponifying cellulose acetate fibers with a degree of acetyl substitution of 2.0 to 3.0 (acetification of 45 to 62.5%) by use of an aqueous solution of strong and weak alkali in such a way as to substitute 27 to 75% of the total acetyl groups of cellulose acetate fibers with hydroxyl groups in order to form a cellulose layer with a mixed crystalline structure of cellulose II and TV; followed by dissolving a cellulose acetate portion which is not saponified by use of an organic solvent.

BRIEF DESCRIPTION OF THE DRAWINGS

The above and other objects, features and other advantages of the present invention will be more clearly understood from the following detailed description taken in conjunction with the accompanying drawings, in which.

BEST MODES FOR CARRYING OUT THE INVENTION

Figure 1:
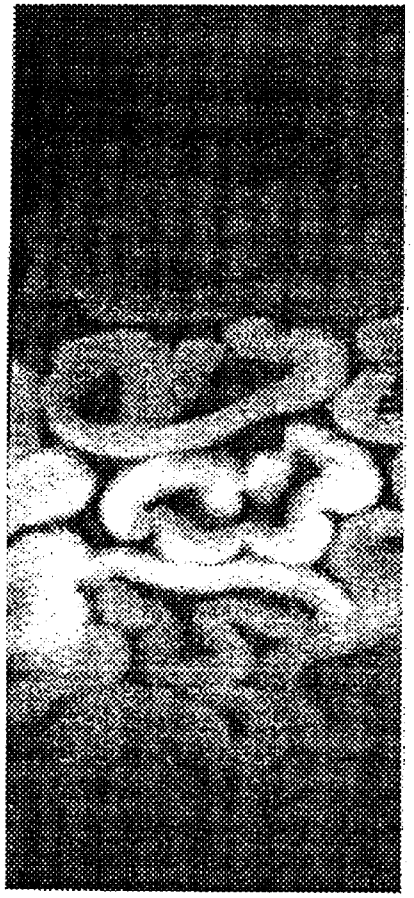
FIG. 1 is a cross sectional view of hollow cellulose fibers according to the present invention.

The present invention is characterized by the partial saponification of cellulose acetate fibers and the dissolving of unsaponified cellulose acetate in producing hollow cellulose fibers.

For use as a raw material for hollow rayon fibers, cellulose acetate has a degree of acetyl substitution of 2.0 to 3.0 (acetification of 45 to 62.5%).

In accordance with the present invention, cellulose acetate fibers are saponified in such a way as to substitute 27 to 75% of the total acetyl groups of cellulose acetate fibers with hydroxyl groups.

The saponification can be achieved by treating cellulose acetate with a combination of strong and weak alkali in one bath or two baths.

Examples of alkali compounds useful in the saponification of the present invention include alkali metal hydroxides, such as sodium hydroxide, alkali earth metal hydroxides, such as calcium hydroxide, and alkali metal salts, such as sodium carbonate. Such alkali compounds may be used independently or in combination with a saponification promoter. Examples of commercially available saponification promoters include NEORATE NCB of Korea Fine Products, which is a phosphonium based saponification promoter; and KF NEORATE NA-40 of Korea Fine Products, DYK-1125 of IPPOSHA Co., Japan, DXY-10N of IPPOSHA Co., Japan, caserine PES of MEISEI CHEMICAL WORKS, LTD., Japan, caserine PEL of MEISEI CHEMICAL WORKS, LTD., Japan, caserine PEF of MEISEI CHEMICAL WORKS, LTD., Japan, and SNOGEN PDS of Dae Young Chemical, Co., Korea, all being quaternary ammonium-based saponified promoters.

In a saponification step, alkali is used in the form of a 10 to 35% aqueous solution based on cellulose acetate fibers, and the cellulose acetate fibers are saponified to cellulose fibers by dipping the cellulose acetate fibers into the aqueous solution at preferably 70° C. to 130° C. for 1 to 120 minutes once or twice so that 27 to 75% of the total acetyl groups of the cellulose acetate fibers can be substituted with hydroxyl groups, but in which the number and condition of the baths is not limited.

The deacetylation with strong alkali yields different degrees of acetyl substitution at the inner and outer layers. In detail, when being treated with strong alkali, cellulose acetate fibers are saponified initially at the outer layer. Accordingly, selective saponification can be achieved only on the surface layer of cellulose acetate fibers, resulting in different degrees of substitution between the outer and inner layers of the fibers.

Solubility of such cellulose acetate fibers in an organic solvent varies with the degree of substitution. Therefore, advantage can be taken of the different solubilities in producing hollow cellulose fibers. The inner layer of surface-saponified acetate fibers can be easily dissolved in an organic solvent owing to its abundant acetyl groups, while the outer layer is not dissolved because most of the acetyl groups in the outer layer are substituted with hydroxyl groups.

Upon saponification of cellulose diacetate with alkali, a molecular structure of cellulose acetate is converted to a molecular structure of cellulose in the outer layer of the saponified fibers, with concomitant rearrangement of molecular chains from an amorphous form to a crystalline form by folding or packing.

Structural analysis showed that a mixed crystalline structure of cellulose II and cellulose IV is present in the saponified cellulose fiber, with a specific gravity is 1.43 to 1.50.

Illustrative, but non-limiting examples of solvents, which can be used for dissolving cellulose acetate portions out of the inner layer of the partially saponified fibers, may include special grade reagents of acetone, dimethylformamide, dimethylacetone, TFA, and 2-methoxyethanol.

According to the present invention, hollow cellulose fibers are produced by dipping partially saponified cellulose acetate fibers into 2-methoxyethanol solution at 20 to 130° C. for 1 to 60 min one to five times to dissolve the unsaponified cellulose acetate in an inner layer of the fibers.

Throughout this specification, weight loss, solubility, degree of deacetylation of cellulose acetate fibers, and breaking strength and breaking elongation of hollow rayon fibers are defined as follows:

*weight loss was calculated from the measurements of sample weights before and after alkali treatment as shown in the following equation:

$$\text{weight loss (\%)} = \frac{\text{(pre-alkali treatment weight-post-alkali treatment weight)}}{\text{pre-alkali treatment weight}} \times 100$$

*solubility was calculated from the measurements of sample weights before and after dissolution as shown in the following equation:

$$\text{solubility (\%)} = \frac{\text{(pre-dissolution weight-post-dissolution weight)}}{\text{pre-dissolution weight}} \times 100$$

*degree of deacetylation: the resulting hollow rayon fiber was analyzed for deacetylation degree with the use of IR spectroscopic analyzer (MAGNA 750, Nicolet, USA), and degrees of deacetylation were obtained by calculating a ratio of a C═O stretching peak area of a cellulose acetate acetyl group at 1760 $cm^{-1}$ to a $CH_2$ bending peak area of cellulose at 1430 $cm^{-1}$ with the use of an integral calculus.

*breaking strength and breaking elongation: breaking strength and breaking elongation was measured by stretching a 50 mm long sample at a rate of 200 mm/min using Universal Testing Machine (Zwick 1425, Germany).

A better understanding of the present invention may be obtained in light of the following examples which are set forth to illustrate, but are not intended to limit the present invention.

EXAMPLE 5-shaft satin fabrics (warp 150 d/33 f, warp density 193 ply/inch, weft 150 d/33 f, weft density 90 ply/inch) comprising diacetate fibers with an degree of acetyl substitution of 2.55 (acetification of 56.9%) were scoured and dried. Into a liquid dyeing machine were charged the satin fabrics and water, along with NaOH at an amount of 10 to 40 wt % based on diacetate, followed by temperature elevation from 30° C. to 98° C. at a rate of 2° C./min. After the maximum temperature was maintained for 30 min, the temperature was allowed to decrease to 30° C. at a rate of 2° C./min. Following the drainage of the liquid, the remaining alkali was removed by washing with water. Next, the fibers drawn out of the machine were dried. Saponification condition and weight loss of cellulose diacetate fibers are described in Table 1, below.

Obtained through the saponification were partially saponified fibers with a weight loss of 10 to 40% based on the weight of the initial diacetate fibers. The partially saponified fibers were treated with 2-methoxyethanol for 30 min at room temperature in a liquid dyeing machine and the liquid was drained. After three repetitions of the methoxyethanol treatment, the fibers were washed with water to remove the remaining solvent. Next, the fibers drawn out of the machine were dried.

Solubilities of diacetate according to saponification conditions are summarized in Table 2, below. The degree of deacetylation was confirmed by IR spectroscopic analysis, as shown in FIG. 1. As seen, a carbonyl band at 1760 $cm^{-1}$, corresponding to an acetyl group, was apparently observed in a portion which was initially cellulose diacetate fibers, while the carbonyl band mostly disappeared in hollow rayon fibers.

Physical properties of the resulting fibers obtained from examples are described in Table 3. Samples 2 to 6 increased in breaking strength and specific gravity, while physical properties of an untreated sample in comparative example 1 were the same as intrinsic physical properties of diacetate.

TABLE 1

| | Saponification condition and weight loss of cellulose diacetate fibers | |
|---|---|---|
| Sample No. | Amount of NaOH (wt % based on diacetate) | Weight loss (%) |
| 1 (C. Ex.) | 0 | 0 |
| 2 | 10 | 11.3 |
| 3 | 15 | 14.5 |
| 4 | 20 | 19.5 |
| 5 | 25 | 25.0 |
| 6 | 30 | 30.1 |

TABLE 2

| | Solubility of saponified samples in 2-methoxyethanol solvent | |
|---|---|---|
| Sample No. | Weight loss (%) | Solubility (%) |
| 1 (C. Ex.) | 0 | 100 |
| 2 | 11.3 | 76.6 |
| 3 | 14.5 | 62.5 |
| 4 | 19.5 | 44.1 |
| 5 | 25.0 | 29.6 |
| 6 | 30.1 | 15.4 |

TABLE 3

| | Physical properties of hollow rayon fibers | | | |
|---|---|---|---|---|
| Sample No. | Denier (De) | Breaking strength (gf/de) | Breaking elongation (%) | Specific gravity |
| 1 (C. Ex.) | 75.0 | 0.68 | 35.6 | 1.3100 |
| 2 | 25.6 | 0.95 | 33.1 | 1.4546 |
| 3 | 55.1 | 0.95 | 40.2 | 1.4362 |
| 4 | 74.6 | 0.97 | 46.1 | 1.4339 |
| 5 | 96.7 | 1.02 | 47.5 | 1.4397 |
| 6 | 105.4 | 1.04 | 49.2 | 1.4465 |

INDUSTRIAL APPLICABILITY

Accordingly, as described above, the present invention advantageously provides a commercial method for producing hollow rayon fibers, which are light and heat insulated, in a simple and sustainable manner.

The present invention has been described in an illustrative manner, and it is to be understood that the terminology used is intended to be in the nature of description rather than of limitation. Many modifications and variations of the present invention are possible in light of the above teachings. Therefore, it is to be understood that within the scope of the appended claims, the invention may be practiced otherwise than as specifically described.

What is claimed is:

1. A method for producing hollow rayon fibers, comprising the steps of:

saponifying cellulose acetate fibers with substitution of 2.0 to 3.0 (acetification of 45 to 62.5%) to substitute 27 to 75% of the total acetyl groups of the cellulose acetate fibers with hydroxyl groups; and dissolving an inner layer of the cellulose acetate fibers to form a hollow cavity, said inner layer remaining unsaponified after the saponifying step.

2. The method as set forth in claim 1, wherein said saponification step is carried out with a combination of strong and weak alkali in one bath.

3. The method as set forth in claim 1, wherein the saponifcation step is carried out with a combination of strong and weak alkali in two baths.

4. The method as set forth in claim 2 or 3, wherein the saponification step is carried out using a saponifying promoter, said saponifying promoter being selected from the group consisting of quaternary ammonium salt, phosphonium salt and mixtures thereof.

5. Hollow rayon fibers produced by the method of claim 1, ranging, in specific gravity, from 1.43 to 1.50 $gm/cm^3$.

* * * * *